US007784797B2

(12) United States Patent
Baugh et al.

(10) Patent No.: US 7,784,797 B2
(45) Date of Patent: Aug. 31, 2010

(54) SEAL AND SLIP ASSEMBLY FOR EXPANDABLE DOWNHOLE TOOLS

(75) Inventors: John L. Baugh, College Station, TX (US); Louis M. Gambertoglio, The Woodlands, TX (US)

(73) Assignee: Baker Hughes Incorporated, Houston, TX (US)

( * ) Notice: Subject to any disclaimer, the term of this patent is extended or adjusted under 35 U.S.C. 154(b) by 288 days.

(21) Appl. No.: 11/437,069

(22) Filed: May 19, 2006

(65) Prior Publication Data

US 2007/0267824 A1 Nov. 22, 2007

(51) Int. Cl.
*F16L 17/00* (2006.01)

(52) U.S. Cl. ..... 277/607; 277/640; 166/208; 166/217

(58) Field of Classification Search ..... 277/591, 277/592, 593, 597–598, 607, 640, 651; 285/347, 285/344, 293.1, 369, 230; 166/208, 217
See application file for complete search history.

(56) References Cited

U.S. PATENT DOCUMENTS 2,127,372 A * 8/1938 Victor et al. ..... 277/592
5,375,893 A * 12/1994 Guest ..... 285/330
5,511,620 A 4/1996 Baugh et al.
6,176,523 B1 * 1/2001 Winslett ..... 285/24
6,439,620 B1 * 8/2002 Guest ..... 285/347
6,467,540 B1 10/2002 Weinig et al.
6,705,615 B2 * 3/2004 Milberger et al. ..... 277/328
6,793,022 B2 * 9/2004 Vick et al. ..... 166/382
6,920,927 B2 * 7/2005 Hirth ..... 166/206

OTHER PUBLICATIONS

Garfield, Gary, et al., "Recent Metal-to-Metal Sealing Technology for Zonal Isolation Applications Demostrates Potential for Use in Hostile HP/HT Environments", SPE/IADC 105854, Feb. 2007, 1-4.
Mackenzie, Gordon, et al., "Wellbore Isolation Intervention Devices Utilizing a Metal-to-Metal Rather Than an Elastomeric Sealing Methodology", SPE109791, Nov. 2007, 1-5.
Jabs, Matthew, et al., "New Expandable Cladding Technique Enables Extended Length Casing Repair", IADC/SPE 87212, Mar. 2004, 1-4.
Wardak, Ajmal, et al., "Expandable Liner Hanger System Enhances Liner Installations by Providing Viable Solutions That Overcome Deployment and Installation Issued in Low-Pressure Reservoirs", SPE 117049, Mar. 2008, 1-9.

(Continued)

*Primary Examiner*—Vishal Patel
(74) *Attorney, Agent, or Firm*—Steve Rosenblatt

(57) ABSTRACT

A sealing and gripping element for an expandable downhole tool features a ring supporting a sealing material with radially extending rings into the sealing material during run in. Expansion of the underlying ring brings the sealing material into contact with the surrounding tubular. It also forces the radially extending rings through the sealing material and into contact with the surrounding tubular. As a result the tips of the extending rings are blunted to create metal to metal seals on the surrounding tubular. Hardened inserts are also located within the sealing material for run in. Upon expansion of the underlying base ring, the inserts break through the sealing material and penetrate the surrounding tubular to enhance grip when high differential pressures are encountered.

14 Claims, 1 Drawing Sheet

OTHER PUBLICATIONS

Louden F., et al., "Development of Hydraulically Expanded Metal Internal Casing Patch", SPE 94056, Apr. 2005, 1-4.

Bargawi, R.A., et al., "Expandable Tubular succcessfully Scab Off Severe Casing Leaks", SPE/IADC 97357, Sep. 2005, 1-4.

* cited by examiner

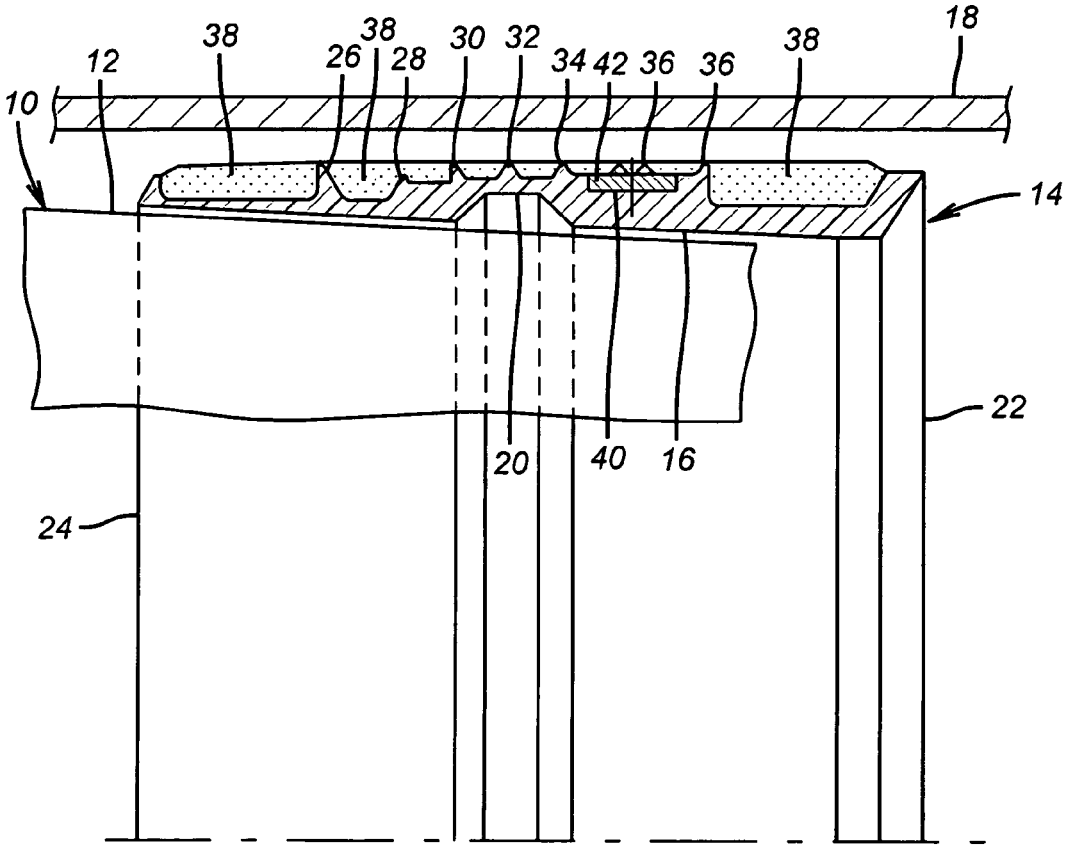
10
12
38
26
38
28
30
32
34
42
36
36
38
18
14
22
20
40
16
24

SEAL AND SLIP ASSEMBLY FOR EXPANDABLE DOWNHOLE TOOLS

FIELD OF THE INVENTION

The field of the invention is sealing and retaining assemblies for downhole tools and more specifically downhole tools set by expansion such as, for example, packers, bridge plugs or liner packers.

BACKGROUND OF THE INVENTION

Downhole tools such as packers and bridge plugs come in a variety of forms. A typical mechanically set packer has slips that are driven along tapered cones to hold the set of a seal element that had previously been compressed. The force to do this can come from hydraulic pressure acting on a piston to create relative movement to compress the sealing element driving it out against the surrounding tubular and then radially displacing the slips to complete the set. One example is U.S. Pat. No. 6,467,540. The setting force can come from setting down weight or by use of available wellbore hydrostatic pressure. Other types of packers simply comprise of inflatable bladders that are set through a valve mechanism by applied pressure or wellbore hydrostatic pressure.

More recently designs of packers and bridge plug has involved setting them by expansion of their core. In the past an outer ring was provided that was thin enough to not present too much resistance to expansion while structurally strong enough to support a sealing element such as an elastomer. These designs featured rings extending radially into the elastomer during run in. On expansion, the tips of the rings would extend beyond the elastomer and contact the surrounding tubular. Such contact was intended to blunt the tips of the radially extending rings so as to create a metal to metal contact interspersed with the contact the elastomer would make with the surrounding tubular. This design offered operators the same type of seal the mechanically set packers provided, where a sealing element is compressed into contact with a surrounding tubular but also offered the requirement of some operators to have metal to metal contact as an additional seal.

This design worked well in the context of a tool expanded from within but it proved to have limits in its ability to resist differential pressure beyond a predetermined level that proved too low for some applications. What is needed is a way to retain the sealing benefits of the design while enhancing its grip capabilities under higher differential pressures. Those skilled in the art will better appreciate the scope of the present invention from a review of the description of the preferred embodiment, the drawing and the claims that appear below and indicate the full scope of the invention.

SUMMARY OF THE INVENTION

A sealing and gripping element for an expandable downhole tool features a ring supporting a sealing material with radially extending rings into the sealing material during run in. Expansion of the underlying ring brings the sealing material into contact with the surrounding tubular. It also forces the radially extending rings through the sealing material and into contact with the surrounding tubular. As a result the tips of the extending rings are blunted to create metal to metal seals on the surrounding tubular. Hardened inserts are also located within the sealing material for run in. Upon expansion of the underlying base ring, the inserts break through the sealing material and penetrate the surrounding tubular to enhance grip when high differential pressures are encountered.

DETAILED DESCRIPTION OF THE DRAWING

The FIGURE is a section view of a ring in the run in position before expansion to seal against a surrounding tubular.

DETAILED DESCRIPTION OF THE PREFERRED EMBODIMENT

FIG. 1 shows schematically a portion of a downhole tool 10 that has a ramp 12 on which ring 14 can move. The movement is relative so either one can move with respect to the other or they can both move in opposite directions. An inner surface 16 has a taper to match the slope of the ramp 12. Ring 14 is designed to expand as the relative movement occurs to bring it radially outwardly toward the surrounding tubular 18. An internal groove 20 is provided preferably near the middle of ring 14 between ends 22 and 24. This groove allows the middle portion to more easily flex to facilitate the ribs 26-36 in coming through the sealing material 38 and engaging the tubular in a metal to metal contact. Generally coinciding with groove 20 but on the exterior of ring 14 are a series of generally radially extending ribs 26, 28, 30, 32, 34 and 36. The number of such ribs can vary and what is illustrated is merely the preferred embodiment. These ribs define valleys between themselves as well as between rib 26 and end 24 and rib 36 and end 22. Preferably all these valleys are filled and then some with a sealing material 38 such that the peaks of all the ribs 26-36 are covered for run in. Again what is illustrated is the preferred embodiment and all the ribs do not need to be covered nor do they all need to be parallel to each other. Ends 22 and 24 are turned out to retain the sealing material against the tubular 18 by minimizing extrusion after expansion to the set position. In the preferred embodiment, the ribs 26-36 form a mirror image about middle rib 32 so that upon expansion of ring 14 the ribs 26-36 will preferably all extend through the sealing material 38 and when contacting the tubular 18 those to the left of rib 32 will flex left and those to the right of rib 32 will flex right. The ends of the ribs will preferably blunt as they contact the tubular 18 leading to a desired metal to metal seal. The flexing to the left and to the right of the ribs as described above also to some degree helps resist differential pressure in either direction from breaking loose the tool 10.

A series of individual recesses or in the alternative a fully circumferential one 40 can each hold a base 42 topped by hardened inserts 44 that can be in specific patterns or randomly arranged. Preferably, during run in, the sealing material 38 covers the inserts. After expansion of the ring 14, the inserts 44 come through the sealing material 38 and bite into tubular 18. In this manner the tool 10 can remain in position despite differential pressures that would have broken it loose had it not had the inserts 44 on bases 42 mounted in a conforming recess such as 40. Inserts 44 may be formed integrally to bases 42 or as separate structures. While many insert patterns or a random arrangement can be used, the preferred embodiment comprises individual bases using a square pattern of 4 inserts. While the array of inserts is shown near one end, those skilled in the art will appreciate that they can be near the other end, near both ends or in other arrangements along the length of ring 14.

While the ring 14 is to be expanded with a swage, any other device to realize that expansion can be used other than relative movement along matching slopes. For example, the mandrel of the tool itself can be expanded within ring 14. The ring can be integrated with or expanded by an inflatable. Ring 14 can serve as part of a liner hanger with a string attached to either end of the tool and a swage or an inflatable tool can be used to expand ring 14 for support from the tubular 18 to support the connected string.

The sealing material should be a resilient material compatible with well materials and temperatures such as an elastomer. Alternatively, a material that swells after a predetermined exposure to well fluids can be used and can be initially covered for the trip into the well, whereupon expansion of ring 14 or simply exposure to well fluids for a certain time undermines the cover and lets the underlying swelling material begin to swell. A metal to metal seal still results and inserts 44 still enhance the grip. The swelling further enhances the seal.

The above description is illustrative of the preferred embodiment and many modifications may be made by those skilled in the art without departing from the invention whose scope is to be determined from the literal and equivalent scope of the claims below:

We claim:

1. A sealing and gripping assembly for a downhole tool against a tubular downhole, comprising:

a structural metallic annularly shaped ring having an inner surface and an outer surface and opposed ends, said ring having an initial annular diameter and a larger annular diameter when sealing and gripping;

a fully circumferential seal supported by said outer surface and having an outer surface that selectively contacts the tubular;

a plurality of ribs extending from said outer surface and into said seal with said seal contacting opposed sides of all said ribs when said ring is in said initial annular diameter and said ribs extending through said outer surface of said seal and into contact with the tubular downhole when said ring is at said larger annular diameter;

a plurality of hardened gripping members received into at least one recess on said outer surface and extending outwardly therefrom; and said plurality of hardened gripping members initially covered by said seal.

2. The assembly of claim 1, wherein:

said gripping member comes though said seal on expansion of said ring from its inner surface.

3. The assembly of claim 1, wherein:

said plurality of hardened gripping members comprises hardened inserts.

4. The assembly of claim 3, wherein:

said hardened inserts are mounted on a base;

said outer surface of said ring comprises said at least one recess to accept said base.

5. The assembly of claim 4, wherein:

said inserts are arranged in a selected pattern.

6. The assembly of claim 4, wherein:

said inserts are randomly arranged.

7. The assembly of claim 5, wherein:

said base is round to fit in said recess that has the same shape;

said ring comprises a plurality of recesses each having its own base with inserts in at least one selected pattern.

8. The assembly of claim 7, wherein:

said recesses are aligned on at least one circumference on said outer surface.

9. The seal assembly of claim 1, wherein:

said plurality of ribs comprises an end that becomes blunted.

10. The seal assembly of claim 1, wherein:

said plurality of ribs configured to flex toward opposite ends of said ring.

11. The assembly of claim 1, wherein:

said seal comprises a swelling material.

12. The assembly of claim 1, wherein:

said ring comprises upturned ends from said outer surface that point away from said outer surface of said ring to contain said seal.

13. The assembly of claim 1, wherein:

said inner surface is tapered.

14. The assembly of claim 8, wherein:

said seal comprises a swelling material.

* * * * *